US007063657B2

(12) United States Patent
Okutsu et al.

(10) Patent No.: US 7,063,657 B2
(45) Date of Patent: Jun. 20, 2006

(54) METHOD OF CONSTRUCTING UNDERGROUND GALLERY BY USING PNEUMATIC TRANSFER SYSTEM AND STRATUM DISPOSAL METHOD

(75) Inventors: Kazuo Okutsu, Tokyo (JP); Hisashi Takamura, Tokyo (JP); Koji Hane, Tokyo (JP); Nobuyuki Matsui, Tokyo (JP); Yasuyuki Hayakawa, Tokyo (JP); Mitsuaki Furuichi, Tokyo (JP)

(73) Assignee: Kajima Corporation, Tokyo (JP)

( * ) Notice: Subject to any disclaimer, the term of this patent is extended or adjusted under 35 U.S.C. 154(b) by 0 days.

(21) Appl. No.: 10/494,648

(22) PCT Filed: Nov. 8, 2002

(86) PCT No.: PCT/JP02/11672

§ 371 (c)(1),
(2), (4) Date: Aug. 30, 2004

(87) PCT Pub. No.: WO03/040523

PCT Pub. Date: May 15, 2003

(65) Prior Publication Data

US 2005/0004416 A1 Jan. 6, 2005

(30) Foreign Application Priority Data

Nov. 9, 2001 (JP) ..... 2001-344537

(51) Int. Cl.
*E21D 9/12* (2006.01)
*G21F 9/34* (2006.01)

(52) U.S. Cl. ..... 588/250; 299/18

(58) Field of Classification Search ..... 299/64, 299/18; 588/250

See application file for complete search history.

(56) References Cited

U.S. PATENT DOCUMENTS 4,184,792 A * 1/1980 Turnbo ..... 406/51

(Continued)

FOREIGN PATENT DOCUMENTS

JP 4326954 * 11/1992

(Continued)

*Primary Examiner*—John Kreck
(74) *Attorney, Agent, or Firm*—Pearne & Gordon LLP

(57) ABSTRACT

A method of constructing underground galleries using a pneumatic transfer system and a stratum disposal method are provided, wherein in constructing a disposal gallery of a stratum disposal site and tunnels such as mountain tunnels or in performing stratum disposal of waste matter, the carrying-out of excavation chips or the like, the carrying-in of materials and equipment or the like and the carrying-in and positioning of waste matter may be effected safely, quickly and reliably at low cost, and the buffer material quality for waste matter may be secured. In construction, an air carrying pipeline (10) is used while extending the air carrying pipeline (10) downward as desired during excavation of a vertical shaft (2) so as to carry out vertical shaft excavation chips (a) to the ground and carry in materials and equipment including vertical shaft spray concrete (b) to the underground site. Alternatively, the vertical shaft itself is used as the air carrying pipeline (10), and by using the air carrying pipeline (10) extending from the vertical shaft (2*a*) to an underground gallery (3), excavation chips (a) from the underground gallery (3) are carried out to the ground and materials and equipment for the underground gallery are carried in to the underground site. In operation, the air carrying pipeline (10) is used to carry in a carrying container (11) with the waste matter (A) and a buffer material (13) integrated together and stored therein, to the underground site, and the integrated waste matter (A) and buffer material (B) are positioned and buried in a disposal hole (7).

8 Claims, 7 Drawing Sheets

U.S. PATENT DOCUMENTS

| | | | | | |
|---|---|---|---|---|---|
| 4,316,682 | A | * | 2/1982 | Evans | 406/187 |
| 4,500,227 | A | * | 2/1985 | Courtois et al. | 405/129.35 |

FOREIGN PATENT DOCUMENTS

| | | | | |
|---|---|---|---|---|
| JP | 6-31878 | B2 | | 4/1994 |
| JP | 07-102898 | | | 4/1995 |
| JP | 10-290968 | A | | 11/1998 |
| JP | 2997969 | B2 | | 1/2000 |
| JP | 2000-44057 | A | | 2/2000 |
| JP | 2001-31244 | A | | 2/2001 |
| JP | 2001-158532 | A | | 6/2001 |
| RU | 2081327 | | * | 6/1997 |
| SU | 1151502 | | * | 4/1985 |
| SU | 1801915 | | * | 3/1993 |

* cited by examiner

METHOD OF CONSTRUCTING UNDERGROUND GALLERY BY USING PNEUMATIC TRANSFER SYSTEM AND STRATUM DISPOSAL METHOD

TECHNICAL FIELD

This invention relates to a method of constructing a stratum disposal site of radioactive waste matter or the like and tunnels such as mountain tunnels by using a pneumatic transfer system and also to a method of performing stratum disposal of the radioactive waste matter or the like.

BACKGROUND ART

In stratum disposal of radioactive waste matter, the radioactive waste matter is stabilized into vitrified matter, the vitrified matter is then stored in an airtight condition in a thick steel plate-made airtight container called an overpack, and the overpack is then positioned and buried in a bedrock having a depth as much as several hundred to several ten hundred meter underground, for instance, through a buffer material (bentonite-contained mixed soil or the like).

FIG. 18 shows one exemplified stratum disposal site, which is composed of access galleries 2 (vertical shafts 2*a*, inclined shafts 2*b* and spiral galleries) that interconnect ground facilities 1 and underground facilities, a large number of disposal galleries 3 that are to position the waste matter (overpack), main galleries 4 that run round the disposal galleries and transfer galleries 5 that interconnect the main galleries. Incidentally, a disposal panel 6 is constructed as a divisional unit composed of the disposal gallery 3 and the main gallery 4 that runs round the above disposal gallery. The advantages of dividing an area for disposal of the waste matter into several independent panels are that flexible layout may be effected depending on geological environmental conditions or the like of the disposal site to ensure that principal works such as construction, operation and closing-up are executable independently in parallel on each panel basis.

In the stage of construction, the construction of the underground facilities and the ground facilities takes place. In the stage of operation, works such as accepting of the vitrified matter, charging of the overpack with the vitrified matter, manufacturing of the buffer material, carrying and positioning of the waste matter and the buffer material and refilling of the disposal galleries and the main galleries mainly take place. In the stage of closing-up, works such as refilling of the transfer galleries and the access galleries and disassembling and dismantling of the ground facilities mainly take place.

In the above stratum disposal site, methods conventionally available as a method of carrying the waste matter and the buffer material from the ground to the underground site and a method of positioning the waste matter and the buffer material in a disposal space are as follows. Incidentally, there are provided Japanese Patent Laid-open Nos. 2001-166093, 9-61594, 9-61595 and 9-61596 etc. as the reference to documents on the related art.

(1) Method of Carrying Waste Matter and Buffer Material (See FIG. 18)

(a) Method (of vertical shaft system) of carrying waste matter A and a buffer material B from the ground to the underground site by using an individual lifting equipment 50 in each access vertical shaft 2*a*

(b) Method (of inclined shaft system) of carrying the waste matter A and the buffer material B from the ground to the underground site by using an individual travelling carrying machine 51 that travels through each access inclined shaft 2*b*

(2) Method of Positioning Waste Matter and Buffer Material (See FIG. 18)

FIG. 18 shows a pattern of lengthwise arrangement of disposal holes, wherein a plurality of vertical disposal holes 7 are constructed in the bottom of the disposal gallery 3 at intervals in a longitudinal direction of the gallery, and the waste matter A is positioned and buried in a lengthwise arrangement in each disposal hole 7. The waste matter A and the buffer material (block) B are carried after being transshipped into an individual automatic remote control positioning apparatus 5, and positioning takes place in such a manner that ① a lower buffer material block B is firstly positioned in each disposal hole 7 by using a remote control robot (a handling device) of the automatic remote control positioning apparatus 52, ② the waste matter A is then positioned in the buffer material block B, given by the above positioning, by using the remote control robot, and ③ an upper buffer material block B is then positioned on the waste matter A by using the remote control robot.

Incidentally, other waste matter positioning and burying patterns than the above pattern of lengthwise arrangement of disposal holes include patterns such as a pattern of horizontal arrangement of disposal galleries, wherein horizontal or inclined disposal galleries are constructed by excavation in parallel at prescribed intervals between a pair of main galleries at the left and right sides, and the waste matter A is positioned and buried in a horizontal arrangement in each disposal gallery at prescribed intervals in the longitudinal direction of the gallery, a pattern of lengthwise arrangement of disposal vertical shafts, wherein vertical disposal galleries (disposal vertical shafts) are constructed by excavation in parallel at prescribed intervals between the main gallery at the upper side and the gallery at the lower side, and the waste matter A is positioned and buried in a lengthwise arrangement in each disposal gallery at prescribed intervals in a vertical direction, and a pattern of horizontal arrangement of disposal holes, wherein horizontal disposal holes are constructed by excavation in the opposite side wall parts of the disposal gallery at intervals in the longitudinal direction of the gallery, and the waste matter A is positioned and buried in a horizontal arrangement in each disposal hole.

In addition, the buffer material B includes mixed soil or the like mainly containing bentonite. The bentonite-contained mixed soil is a material having dynamic buffering functions, low permeability and low diffusibility of radioactive matter, in other words, a material that is effective in reducing bedrock pressure or underground water effects to ensure that retardation of nuclide migration is achievable.

(1) Problems of the conventional method of carrying the waste matter and the buffer material (a) In the case of vertical shaft system, there is a possibility of bringing about a fall of the waste matter a. The fall of the waste matter, if caused, is likely to lead to serious disasters.

(b) In the case of the vertical shaft system, a dead load of a wire rope of the lifting equipment 50 increases with greater shaft depth, so that a remarkable reduction in permissible lifting capacity (a waste matter weight obtained by taring the rope dead load) is caused.

(c) In the case of the vertical shaft system, it is difficult to increase a lifting speed, because of the possibility of being in danger of the fall of the waste matter A and the necessity to decrease a load applied to the wire rope.

(d) In the case of the inclined shaft system, application of a load to a speed reduction (stopping) device of the traveling carrying machine 51 is caused. When the speed reduction device develops troubles, there is a fear that runaway of the waste matter A occurs, leading to serious disasters.

(e) In the case of the inclined shaft system, an increase of reliability on control of the traveling carrying machine 51 requires an expensive machine.

(f) In the case of the inclined shaft system, arrangements of the secondary equipment such as rail and traction wire arrangements are required, leading to an increase in cost.

(2) Problems of the Conventional Method of Positioning the Waste Matter and the Buffer Material (a) An extremely precise automatic remote control positioning apparatus 52 is required for execution of individual positioning of the waste matter A and the buffer material B in the disposal holes or the like, leading to an increase in cost.

(b) If the positioning results in a failure, it is difficult to effect restoration by an automatic remote control operation.

(c) For the positioning of the buffer material blocks in the disposal holes or the like in such a manner as to divide the buffer material into blocks, it is difficult to secure a buffer material quality obtained after the positioning of the buffer material.

While the above problems are those given in the stage of operation, the same problems as those shown in the above section (1) are also created in the stage of construction of the disposal galleries, since the carrying-out of the excavation chips and the carrying-in of the materials and equipment for construction of the disposal galleries are effected also by using the lifting equipment 50 or the traveling carrying machine 52 in the access galleries 2 in the stage of construction.

DISCLOSURE OF THE INVENTION

The present invention has been undertaken in order to eliminate the above problems, and an object of the present invention is to provide a method of constructing underground galleries, wherein in constructing disposal galleries in a stratum disposal site or tunnels such as mountain tunnels, the carrying-out of excavation chips or the like and the carrying-in of materials and equipment or the like may be effected safely, quickly and reliably at low cost, and also a stratum disposal method, wherein the carrying-in of waste matter in the stratum disposal site may be effected safely, quickly and reliably at low cost, the positioning of the waste matter and a buffer material in the stratum disposal site may be also effected safely, quickly and reliably at low cost, and the quality of the buffer material may be secured easily.

According to a first aspect of the present invention, there is provided a method of constructing underground galleries by using a vertical shaft or an inclined shaft, specifically, a method of constructing underground galleries, wherein an air carrying pipeline is used while extending the air carrying pipeline downwards as desired during excavation of the vertical shaft or the inclined shaft so as to carry out vertical shaft or inclined shaft excavation chips to the ground and also carry in materials and equipment for the vertical shaft or the inclined shaft to the underground site, and by using the air carrying pipeline extending from the vertical shaft or the inclined shaft to an underground gallery, excavation chips from the underground gallery are carried out to the ground or the materials and equipment for the underground gallery are carried in to the underground site. In the underground galleries, the air carrying pipeline is used for both of the carrying-out of the excavation chips and the carrying-in of the materials and equipment, or alternatively, for either of the carrying-out of the excavation chips or the carrying-in of the materials and equipment.

The construction method according to the first aspect of the present invention is a method, which is applied to construction of the underground galleries in the stratum disposal site of the waste matter and the mountain tunnels or the like, and in which the air carrying pipeline is arranged in the vertical shaft or the inclined shaft, and by using the air carrying pipeline and a carrying container (a so-called capsule transport line), the carrying-out of the excavation chips from the vertical shaft, the inclined shaft or the underground gallery to the ground, and the carrying-in of the materials and equipment including the spray concrete for the vertical shaft, the inclined shaft or the underground gallery to the underground site are effected (See FIG. 1). Alternatively, in the underground galleries, other paths or other carrying means are also available for the carrying-out of the excavation chips or the carrying-in of the materials and equipment.

According to a second aspect of the present invention, there is provided a method of constructing underground galleries by using a vertical shaft or an inclined shaft, specifically, a method of constructing underground galleries, wherein the vertical shaft or inclined shaft itself constructed by excavation is used as an air carrying pipeline, and by using the air carrying pipeline, excavation chips from the underground gallery are carried out to the ground or materials and equipment for the underground gallery are carried in to the underground site. In the above construction method, the air carrying pipeline is also used in the underground galleries for both of the carrying-out of the excavation chips and the carrying-in of the materials and equipment, or alternatively, either of the carrying-out of the excavation chips or the carrying-in of the materials and equipment.

The construction method according to the second aspect of the present invention is a method, which is applied to construction of the underground galleries in the stratum disposal site of the waste matter and the mountain tunnels or the like, and in which the air carrying pipeline is constructed in such a manner that the vertical shaft or the inclined shaft for air carrying is constructed by excavation and a lining material and a membrane or the like respectively adapted to bear a strength and an air-tightness are then placed on the inner side wall of the vertical shaft or the inclined shaft, and by using the vertical shaft-and-air carrying pipeline and the carrying container (the so-called capsule transport line), the carrying-out of the excavation chips from the vertical shaft, the inclined shaft or the underground gallery to the ground, and the carrying-in of the materials and equipment including the spray concrete for the vertical shaft, the inclined shaft or the underground gallery to the underground site are effected (See FIG. 2). Alternatively, other paths or other carrying means are also available for the carrying-out of the excavation chips or the carrying-in of the materials and equipment in the underground galleries.

According to a third aspect of the present invention, there is provided a stratum disposal method of performing stratum disposal of waste matter in an underground disposal space, specifically, a stratum disposal method, wherein an air carrying pipeline is arranged in an access vertical shaft or an access inclined shaft extending to an underground gallery, and by using the air carrying pipeline, the waste matter is carried in to the underground gallery for positioning and burying of the waste matter in the disposal space.

The stratum disposal method according to the third aspect of the present invention is a method, which is applied to disposal of the waste matter (the so-called overpack) such as radioactive wastes, for instance, by positioning and burying the waste matter, together with the buffer material, in the underground disposal space (a disposal gallery or disposal holes provided for the disposal gallery or the like), and in which the air carrying pipeline is arranged in the access vertical shaft or the access inclined shaft, and by using the air carrying pipeline and the carrying container (the so-called capsule transport line), the carrying-in of the waste matter to the underground gallery is effected (See FIG. 1). The air carrying pipeline and an automatic remote control positioning apparatus or the like may be used for the carrying of the waste matter to the disposal space to ensure that the waste matter is positioned and buried, together with the buffer material, in the disposal space.

According to a fourth aspect of the present invention, there is provided a stratum disposal method of performing stratum disposal of waste matter in an underground disposal space, specifically, a stratum disposal method, wherein a vertical shaft or an inclined shaft itself constructed by excavation is used as an air carrying pipeline, and by using the air carrying pipeline, the waste matter is carried in to the underground gallery, for positioning and burying of the waste matter in the disposal space.

The stratum disposal method according to the fourth aspect of the present invention is a method, which is applied to disposal of the waste matter (the so-called overpack) such as the radioactive waste, for instance, by positioning and burying the waste matter, together with the buffer material, in the underground disposal space (the disposal gallery or the disposal holes provided for the disposal gallery), and in which the air carrying pipeline is constructed in such a manner that the vertical shaft or the inclined shaft for air carrying is constructed by excavation and a lining material and a membrane or the like respectively adapted to bear a strength and an air-tightness are placed on the inner side wall of the vertical shaft or the inclined shaft, and by using the vertical shaft-and-air carrying pipeline and the carrying container (the so-called capsule transport line), the carrying-in of the waste matter to the underground gallery is effected (See FIG. 2). The air carrying pipeline and the automatic remote control positioning apparatus or the like may be used for the carrying of the waste matter to the disposal space to ensure that the waste matter is positioned and buried, together with the buffer material, in the disposal space.

According to a fifth aspect of the present invention, in the stratum disposal method according to last described above, there is provided the stratum disposal method, wherein a carrying matter obtained by integrating the waste matter and the buffer material together is carried by pneumatic transfer, and is positioned and buried in a disposal space.

According to a sixth aspect of the present invention, the air carrying pipeline has, at a lower part, an air valve which permits the inflow of air into the pipeline and checks the outflow of air to the outside of the pipeline.

Specifically, for a pneumatic transfer system according to the present invention, while use is made of systems such as a suction system, wherein an exhaust device is arranged at an upper part of the air carrying pipeline, a press-in system, wherein an exhaust device is arranged at a lower part of the air carrying pipeline, and a system, wherein the exhaust device is arranged at both of the upper and lower parts of the air carrying pipeline, a pneumatic transfer system having the air valve of check valve type at the lower part of the air carrying pipeline is effective in performing supply of air into the pipeline or ventilation of the underground facilities and the tunnels efficiently in a valve opened condition, and also enables a pneumatic damper effect to be obtained in a valve closed condition. Thus, even if troubles or the like with the system bring about a spontaneous fall condition, the damper effect is expected to be active, with the result that the safety is secured.

Incidentally, according to the present invention, the vertical shaft is a shaft constructed in a vertical position by excavation, and the inclined shaft includes a linear-shaped or partly curved shaft constructed in an inclined position by excavation.

In the present invention, since (1) the pneumatic transfer system is used to carry out and carry in the carrying matter using a difference between pneumatic pressures at the upper and lower sides of the carrying matter, ① it is allowable to dispense with the conventional wire rope so that any restriction by a depth is eliminated to ensure that carrying even to a greater depth is executable, ② a carrying speed may be increased as compared with a conventional wire rope system, ③ the transfer system requires only the differential pressure management, leading to an increase in carrying reliability, ④ a transfer system mechanism is simple, so that high resistance to troubles is obtainable, and maintenance or management thereof also becomes facilitated, and ⑤ there is no necessity of a precise carrying machine, resulting in an increase in economical efficiency. With the above advantages, the carrying-out of the excavation chips or the like and the carrying-in of the materials and equipment or the like in construction of the stratum disposal site and the mountain tunnels or the like, and the carrying-in of the waste mater in the stratum disposal site and the positioning of the waste matter and the buffer material in the stratum disposal site may be effected safely, quickly and reliably at low cost.

(2) With the operation of the pneumatic transfer system, it is allowable to perform suction of air in the underground facilities or the tunnels to ensure that ventilation of air in the underground facilities or the tunnels is achievable. The air carrying pipeline is also serviceable as a ventilating vertical shaft, and thus requires no arrangement of other ventilation systems, leading to an increase in economical efficiency.

(3) With the use of the vertical shaft or the like itself as a part of the pneumatic transfer system, ① the air carrying pipeline having the strength and the air-tightness may be constructed easily only by placing the lining material and the membrane or the like on the inner side wall of the vertical shaft or the like, and ② a compact transfer system may be given to ensure that a diameter reduction of the vertical shaft or the like is attainable. The above advantages lead to an increase in economical efficiency.

(4) The carrying container is put to practical use in the stratum disposal of the radioactive waste matter, and the waste matter and the buffer material are integrated together at the ground facilities. By positioning and burying the integrated waste matter and buffer material in the disposal space of the underground facilities together with the carrying container, ① there is no necessity to position the waste matter A and the buffer material B individually in the underground site, unlike a conventional technology, so that the positioning work may be effected safely, quickly and reliably at low cost, and the positioning reliability and the quality of the buffer material are increased. ② No swelling of the buffer material is caused because of no permeation of the underground water in the buffer material for a certain period of time since the positioning of the buffer material, so that retrieving becomes facilitated, and a removal work is also performed easily.

(5) With the air valve provided at the lower part of the air carrying pipeline, the outflow of air from the vertical shaft or the like into the underground facilities or the tunnels is prevented, so that even if a stop of the power supply or the like in the course of carrying brings about the spontaneous fall condition of the carrying matter, the damper effect obtained by a compression action of air at the lower part of the air carrying pipeline may be adapted to prevent disasters caused by a crash of the carrying matter against the lower part of the underground facilities or the like.

BEST MODE OF CARRYING OUT THE INVENTION

Figure 1:
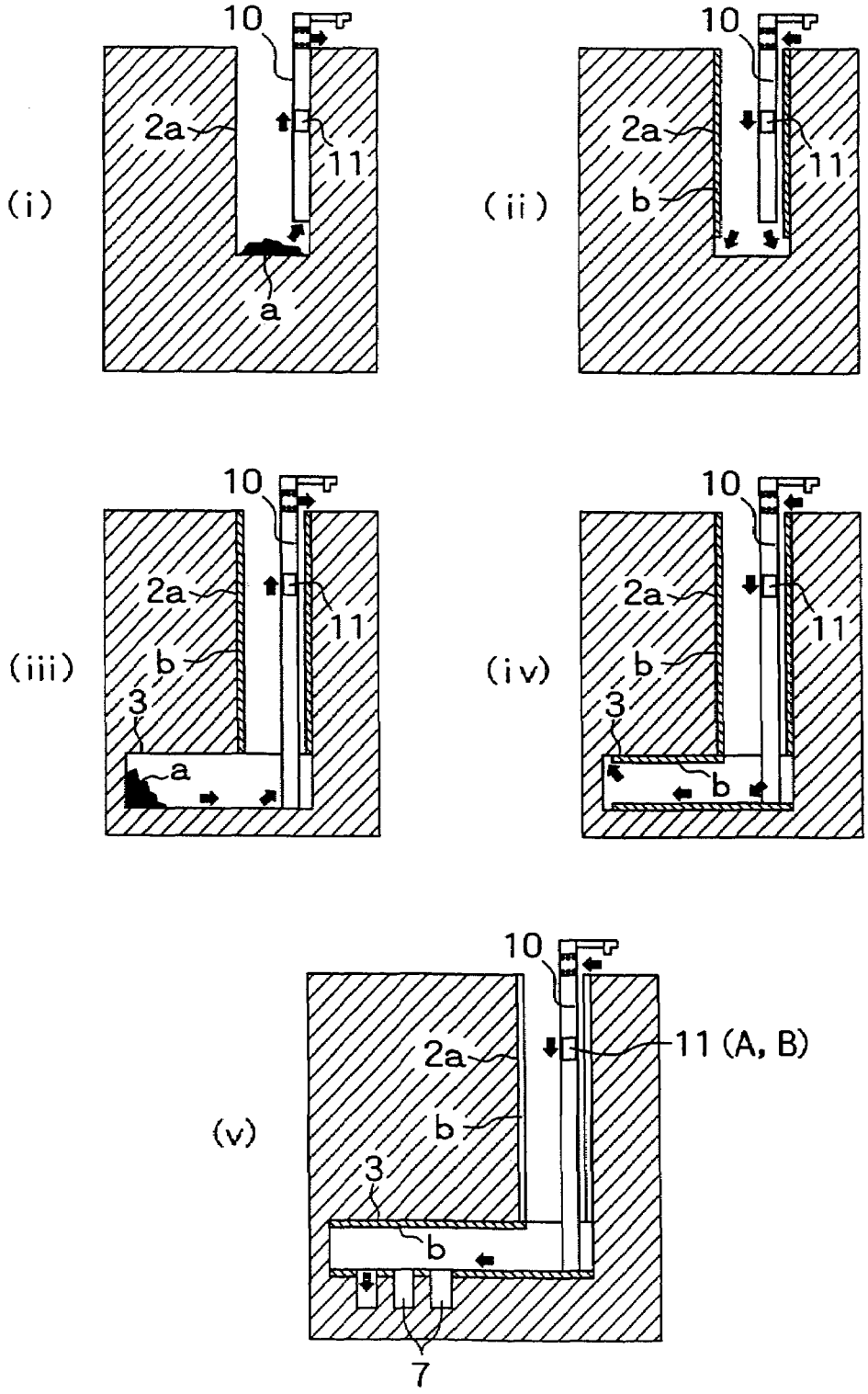
FIG. 1 is a sectional view showing one embodiment of a constructing method and a stratum disposal method according to the present invention, specifically, a construction stage and an operation stage in progress order when an air carrying pipeline is placed in an access vertical shaft of a stratum disposal site, wherein FIGS. 1(*i*) and (*ii*) show stages of construction of a vertical shaft, FIGS. 1(*iii*) and (*iv*) show stages of construction of a horizontal gallery and FIG. 1(*v*) shows a stage of operation.
Figure 2:
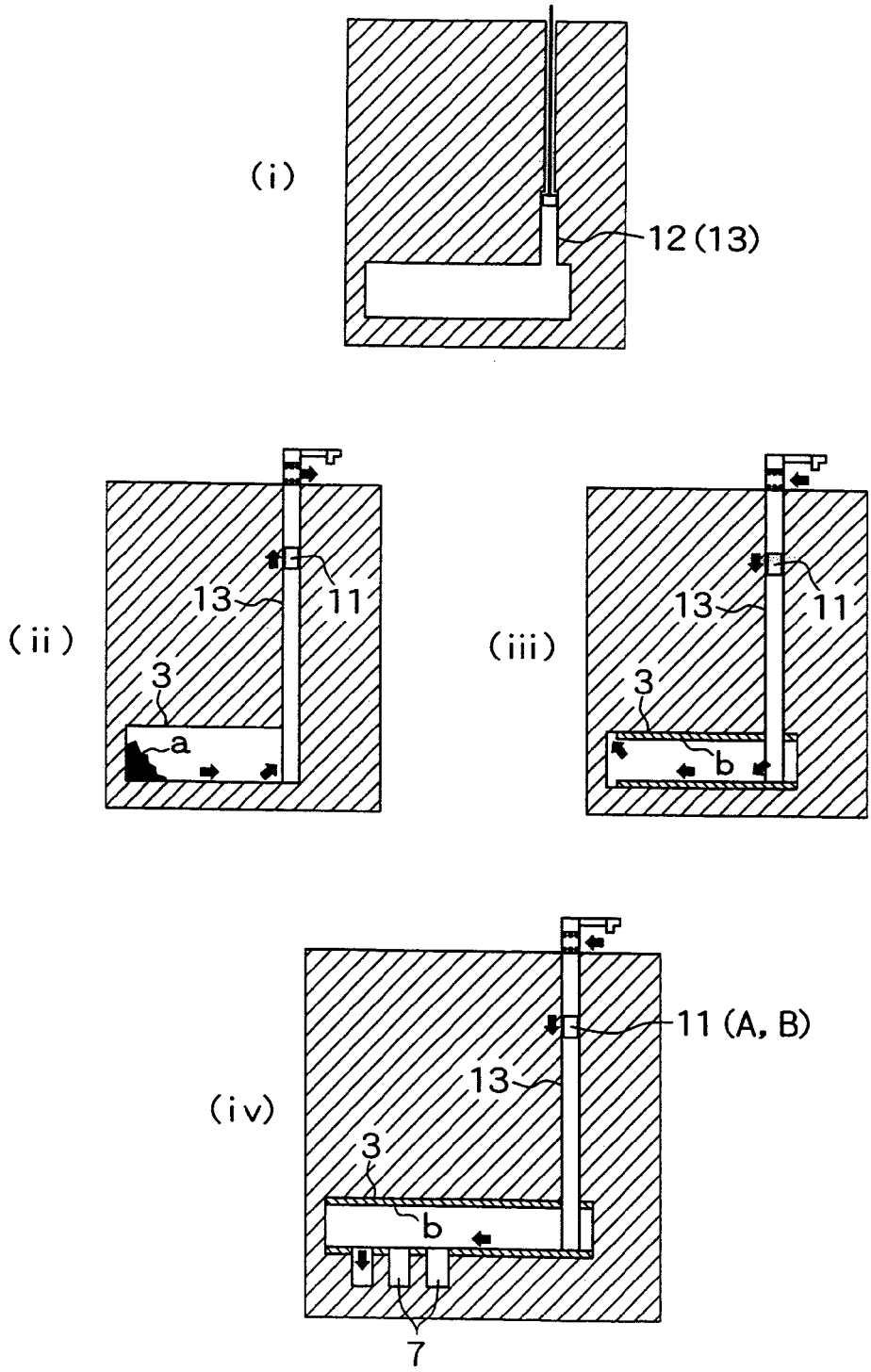
FIG. 2 is a sectional view showing one embodiment of a constructing method and a stratum disposal method according to the present invention, specifically, a construction stage and an operation stage in progress order when an individual vertical shaft is used as the air carrying pipeline, wherein FIG. 2(*i*) shows a stage of construction of a vertical shaft, FIGS. 2(*ii*) and (*iii*) show stages of construction of a horizontal gallery, and FIG. 2(*iv*) shows a stage of operation.
Figure 3:
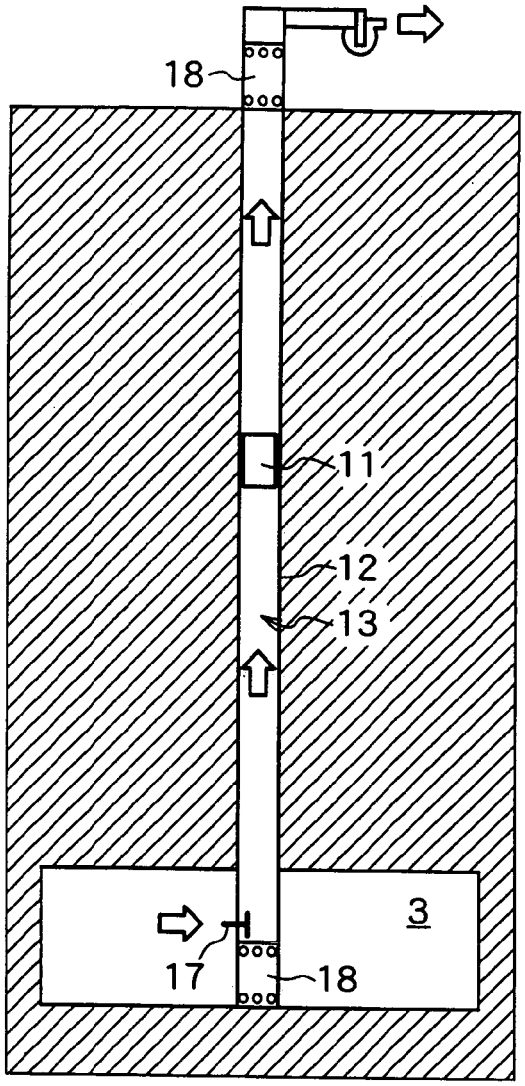
FIG. 3 is a sectional view showing an outline of the whole pneumatic transfer system for use in the present invention.

Hereinafter, the present invention will be described with reference to an illustrated embodiment. The embodiment of the present invention is that attained by applying the present invention to stratum disposal of radioactive waste matter. FIG. 1 shows a construction stage and an operation stage in order when an air carrying pipeline is placed in an access vertical shaft of a stratum disposal site. FIG. 2 shows a construction stage and an operation stage in order when an individual vertical shaft is used as the air carrying pipeline. FIG. 3 shows an outline of a pneumatic transfer system for use in the present invention.

[A] For Placement of the Air Carrying Pipeline in the Access Vertical Shaft of the Stratum Disposal Site (1) This stage is that of construction of the vertical shaft, and as shown in FIG. 1(*i*), an air carrying pipeline 10 is placed in a vertical position, while an access vertical shaft 2*a* is constructed by excavation from the ground. The pipeline 10 is extended downwards successively with the advance of construction of the vertical shaft 2*a* by excavation. Then, excavation chips a are stored in a carrying container (capsule) 11 and are then carried out to the ground by pneumatic transfer of suction system with negative pressure or of press-in system with positive pressure.

(2) This stage is also that of construction of the vertical shaft, and as shown in FIG. 1(*ii*), materials and equipment including spray concrete b are stored in the carrying container 11 and are then carried in from the ground to the bottom of the vertical shaft 2*a* under excavation by pneumatic transfer of suction or press-in system. The carrying-out of the excavation chips a and the carrying-in of the materials and equipment b take place in an alternate manner to proceed the execution of work of the spray concrete b to an upper part of the vertical shaft while advancing the excavation.

(3) This stage is that of construction of the horizontal gallery, and as shown in FIG. 1(*iii*), the excavation chips a from a disposal gallery 3 are stored in the carrying container 11 and are then carried out to the ground by pneumatic transfer of suction or press-in system.

(4) This stage is also that of construction of the horizontal gallery, and as shown in FIG. 1(*iv*), the materials and equipment including the spray concrete b for the disposal gallery 3 are stored in the carrying container 11 and are then carried in from the ground into the disposal gallery 3 at the bottom of the vertical shaft 2*a* by pneumatic transfer of suction or press-in system.

Incidentally, in the stage of construction of the horizontal gallery, other paths such as the vertical shafts and the galleries or other carrying means are also available for the carrying-out of the excavation chips a or the carrying-in of the materials and equipment.

(5) This stage is that of operation, and as shown in FIG. 1(*v*), waste matter A and a buffer material B are stored in the carrying container 11 and so on (as will be described later) and are then carried in from the ground into the disposal gallery 3 by pneumatic transfer of suction or press-in system to ensure that the waste matter A is positioned and buried in a disposal hole 7.

Specifically, transfer of the waste matter for positioning may take place also using an automatic remote control positioning apparatus or the like. Or alternatively, it is also allowable to apply the air carrying pipeline 10 to the transfer of the waste matter for positioning in such a manner as to place the air carrying pipeline 10 also in the disposal gallery 3.

The air carrying pipeline 10 is also serviceable as an exhaust shaft for ventilation of the underground facilities as will be described later, and thus requires no arrangement of other ventilation systems, leading to an increase in economical efficiency.

[B] For Use of an Individual Vertical Shaft as the Air Carrying Pipeline (1) This stage is that of construction of the vertical shaft, and as shown in FIG. 2(*i*), an individual vertical shaft 12 for carrying is constructed with a raise boring machine or the like for use in a rising construction method. A lining material and a membrane are given to an inside surface of the vertical shaft 12 constructed by excavation, as will be described later, and the vertical shaft 12 is used as an air carrying pipeline 13. The individual vertical shaft 12 for carrying is also served as a ventilating vertical shaft, as will be described later.

(2) This stage is that of construction of the horizontal gallery, and as shown in FIG. 2(*ii*), the excavation chips a from the disposal gallery 3 are stored in the carrying container 11 and are then carried in to the ground by pneumatic transfer of suction or press-in system by using the air carrying pipeline 13 obtained by the individual vertical shaft.

(3) This stage is also that of construction of the horizontal gallery, and as shown in FIG. 2(*iii*), the materials and equipment including the spray concrete b for the disposal gallery 3 are stored in the carrying container 11 and are then carried in from the ground into the disposal gallery 3 by pneumatic transfer of suction or press-in system by using the air carrying pipeline 13 obtained by the individual vertical shaft.

Incidentally, in the stage of construction of the horizontal gallery, other paths such as the vertical shafts and the galleries or other carrying means are also available for the carrying-out of the excavation chips a or the carrying-in of the materials and equipment.

(4) This stage is that of operation, and as shown in FIG. 2(*iv*), the waste matter A and the buffer material B are stored in the carrying container 11 and so on (as will be described later) and are then carried in from the ground into the disposal gallery 3 by pneumatic transfer of suction or press-in system by using the air carrying pipeline 13 obtained by the individual vertical shaft to ensure that the waste matter A is positioned and buried in the disposal hole 7.

Specifically, the transfer of the waste matter for positioning in this case may take place also using the automatic remote control positioning apparatus or the like. Or alternatively, it is also allowable to apply the air carrying pipeline 10 to the transfer of the waste matter for positioning in such a manner as to place the air carrying pipeline 10 also in the disposal gallery 3.

With the use of the vertical shaft itself as a part of a pneumatic transfer system as described the above, ① the air carrying pipeline having the strength and the air-tightness may be constructed only by placing the lining material and the membrane on the inner side wall of the vertical shaft. ② The compact transfer system may be given to ensure that a vertical shaft diameter reduction is attainable. The above advantages lead to an increase in economical efficiency. ③ The vertical shaft 12 itself is also serviceable as the exhaust shaft for ventilation of the underground facilities as will be described later, and thus requires no arrangement of other ventilation systems, leading to an increase in economical efficiency.

[C] Pneumatic Transfer System

Figure 4:
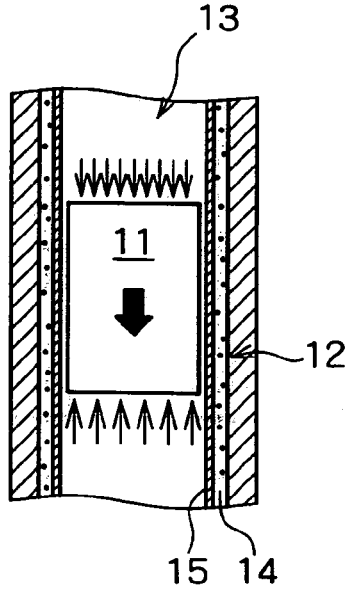
FIG. 4 is a partially enlarged sectional view showing the air carrying pipeline of FIG. 3.
Figure 5:
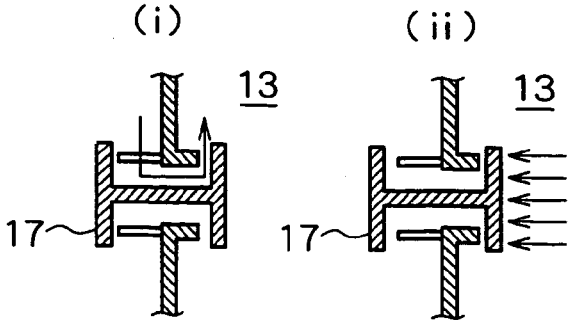
FIG. 5 is a partially enlarged sectional view showing an open condition and a closed condition of an air valve of FIG. 3.

FIGS. 3 to 5 show an embodiment of the air carrying pipeline 13 applied to the above case [B], and the air carrying pipeline 13 having the strength and the air-tightness is constructed by giving a lining material (such as concrete) 14 and a membrane (such as a stainless steel plate) 15 to an inner wall surface of the individual vertical shaft 12 constructed by excavation of a bedrock. It is noted that the air carrying pipeline 10 applied to the above case [A] is constructed by connecting steel pipe units together.

An exhaust device 16 such as a blower is placed at an upper part of the air carrying pipeline 13 (or 10), and an air valve 17 is provided at a lower part thereof to control a carrying speed (an ascend speed and a descend speed) of the carrying container 11 by managing a difference between pneumatic pressures at the upper and lower sides of the carrying container 11 in such a manner as to effect the exhaust of air through the upper part and the suction of air through the lower part. Although the illustrated embodiment employs the negative pressure suction system, the present invention is not limited to the above system, and a positive pressure press-in system with the blower or the like arranged at the lower part or a system with the blower or the like arranged at both of the upper and lower parts is also available.

With the above pneumatic transfer system, ① it is allowable to dispense with the wire rope required for the conventional vertical shaft system so that any restriction by a depth is eliminated to ensure that carrying even to the greater depth is executable. ② A carrying speed is increased. ③ The transfer system is simple because of only the need for the differential pressure management, leading to an increase in carrying reliability. ④ A transfer system mechanism is simple, so that high resistance to troubles is obtainable and the maintenance or management thereof becomes facilitated. ⑤ There is no necessity of a precise carrying machine, resulting in an increase in economical efficiency.

As shown in FIG. 5, the air valve 17 is a kind of check valve and has a structure in which an opened condition is automatically given by the flow of air created at the time of carrying to ensure that the inflow of air from the underground facilities to the air carrying pipeline 13 is permitted, while a closed condition is automatically given by the reverse flow of air created at the time of system troubles or spontaneous falling to ensure that the outflow of air from the air carrying pipeline 13 to the underground facilities is prevented.

Figure 6:
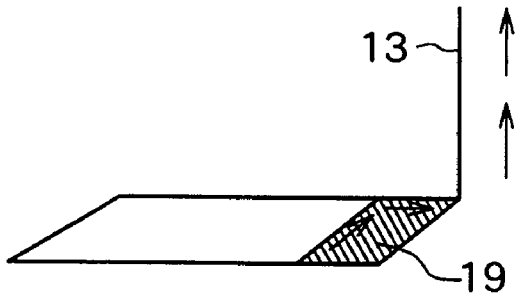
FIG. 6 is a schematic perspective view showing a ventilating system obtained by the individual vertical shaft of FIG. 2.

Thus, ① with the operation of the pneumatic transfer system, the air valve 17 is opened automatically to effect the suction of air in the underground facilities for the exhaust to the ground, thereby enabling the ventilation in an administrative area of the underground facilities, as shown in FIG. 6. In other words, the individual vertical shaft 12 for carrying is also serviceable as the ventilating vertical shaft, and thus requires no arrangement of other ventilating systems, leading to an increase in economical efficiency. ② Even if a stop of the power supply or the like in the course of carrying brings about a spontaneous fall condition of the carrying container 11 or the like, the reverse flow of air allows the air valve 17 to be closed automatically to ensure that a compression action (a vertical shaft damper effect) of air in an airtight condition at the lower part of the vertical shaft is adapted to prevent disasters caused by a crash of the waste matter A against the lower part of the facilities. In other words, a failsafe function is secured.

As shown in FIG. 3, the air carrying pipeline 13 has also, at the upper and lower parts, detachable devices 18. The upper and lower parts of the air carrying pipeline 13 are respectively composed of steel pipes, and loading and unloading of the carrying container 11 or the like are effected in such a manner as to horizontally slide movable steel pipes for the above steel pipes using a traverse carriage and so on.

Figure 7:
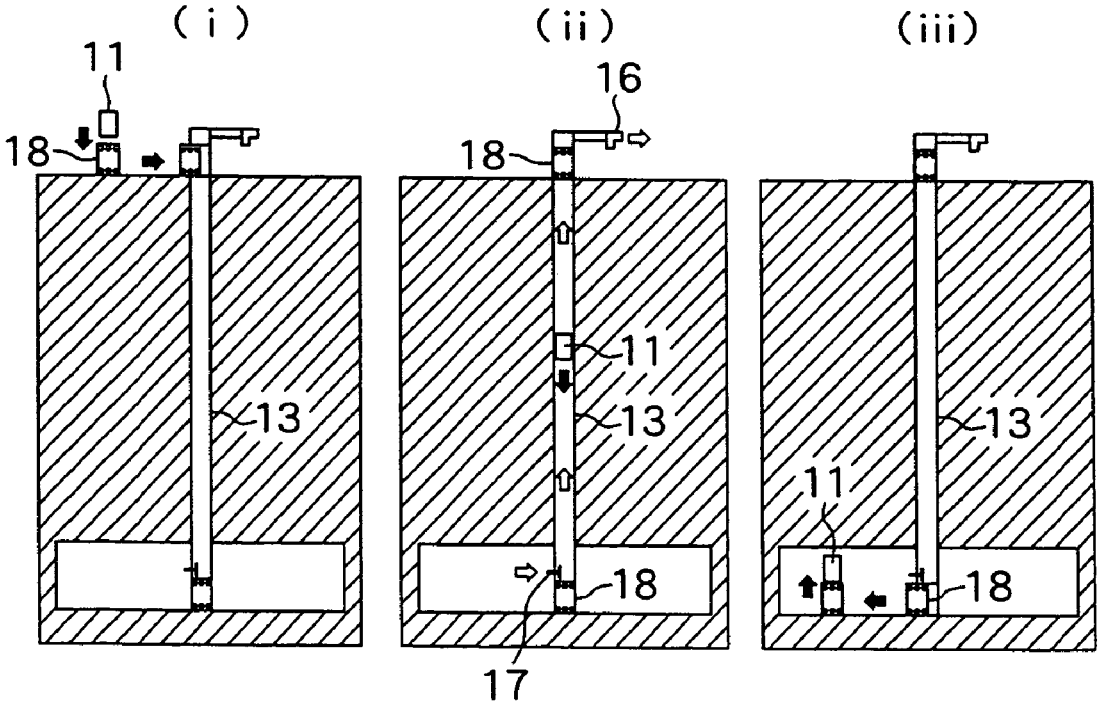
FIG. 7 is a sectional view showing one embodiment of a carrying container carrying-in process.

FIG. 7 shows an embodiment of a carrying container-11 carrying-in process. (1) The carrying container 11 with the materials and equipment, the waste matter or the buffer material or the like stored therein is inserted into the upper detachable device 18, and this upper detachable device 18 is then set at the upper part of the air carrying pipeline 13. (2) The exhaust device 16 is operated to carry the carrying container 11 to the underground site, while managing the difference between the pneumatic pressures at the upper and lower sides of the carrying container 11. (3) The lower detachable device 18 is detached from the lower part of the air carrying pipeline 13 to take out the carrying container 11 from the lower detachable device 18.

[D] Waste Matter and Buffer Material

Figure 8:
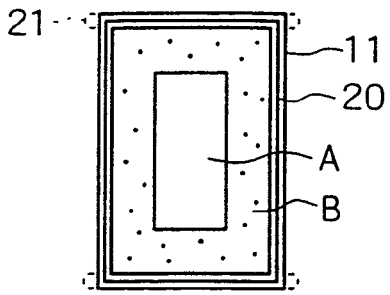
FIG. 8 is a sectional view showing one embodiment of a carrying matter structure.
Figure 9:
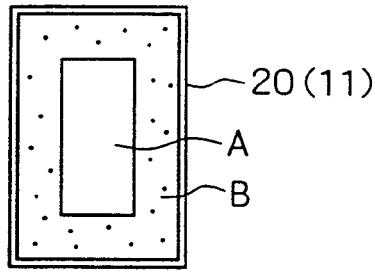
FIG. 9 is a sectional view showing a different embodiment of the carrying matter structure.
Figure 10:
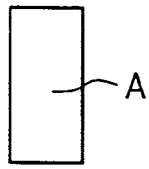
FIG. 10 is a sectional view showing a different embodiment of carrying matter.

FIGS. 8 to 10 show various kinds of carrying matter forms. FIGS. 8 and 9 show a case where the carrying of the waste matter A (overpack) and the buffer material (bentonite-contained mixed soil) B that are integrated together is effected, and the integrated waste matter A and buffer material B are positioned and buried. In the case shown in FIG. 8, the waste matter A and the buffer material B are stored in an integrating container 20 at the ground facilities, and the carrying of the integrating container 20 is effected with the integrating container 20 further inserted into the carrying container 11. In the case shown in FIG. 9, the waste matter A and the buffer material B are stored in the integrating container 20 at the ground facilities, and the carrying of the integrating container 20 is effected as it is with the integrating container 20 as the carrying container 11.

The carrying matter form is not limited to the above forms, and it is also allowable to carry the waste matter A as it is without using the carrying container, as shown in FIG. 10. Further, the carrying of the waste matter A may be also effected with the waste matter A stored in the carrying container 11. In this case, the carrying of the buffer material B is effected separately with the buffer material B stored in the carrying container 11.

In addition, spacers 21 such as wheels mounted to an outer circumference of the carrying container 11 as shown in FIG. 8 are effective in preventing the membrane of the air carrying pipeline from being damaged by the container during the carrying, leading to an increase in pneumatic transfer system durability. Further, a seal material is provided on the outer circumference of the carrying container 11 as needed.

Figure 11:
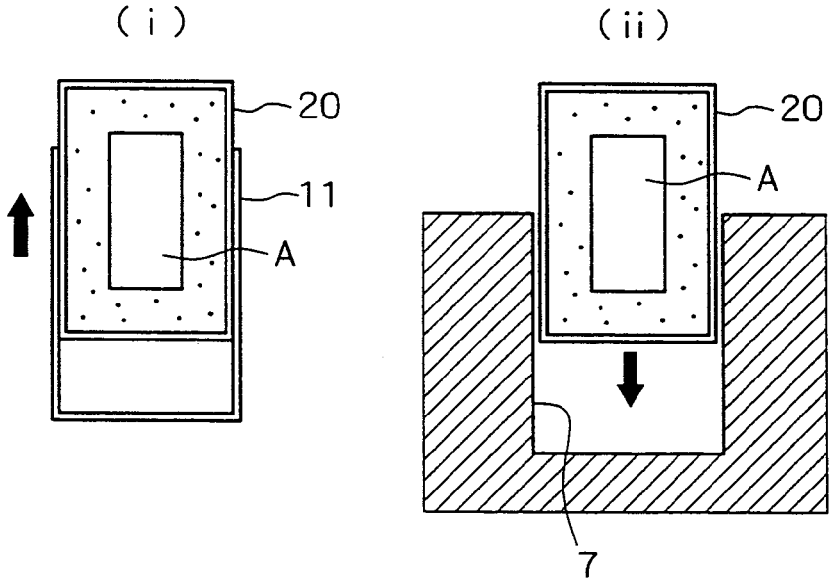
FIG. 11 is a sectional view showing a work of positioning of the carrying matter in a disposal hole in progress order.

In use of the carrying container 11 shown in FIG. 8, removal of the integrating container 20 from the carrying container 11 is effected, and this integrating container 20 is positioned and buried in the disposal hole 7 as it is, as shown in FIG. 11. In use of the carrying container 11 shown in FIG. 9, the received integrating container 20 serving also as the carrying container is also positioned and buried in the disposal hole 7 as it is.

With the use of the integrating container in which the waste matter A and the buffer material B are integrated together as described the above, ① there is no necessity to position the waste matter A and the buffer material B individually in the underground site, unlike the conventional technology, so that the positioning work may be effected safely, quickly and reliably at low cost, and the positioning reliability and the buffer material quality are increased. ② With the integrating container 20 positioned in the disposal hole 7 as it is, no swelling of the buffer material is caused because of no permeation of the underground water into the buffer material B during the period of operation (until a period of time when a corrosion hole is caused in the integrating container), so that the retrieving during the above period becomes facilitated. Also, the removal for each integrating container 20 may be easily performed.

Figure 12:
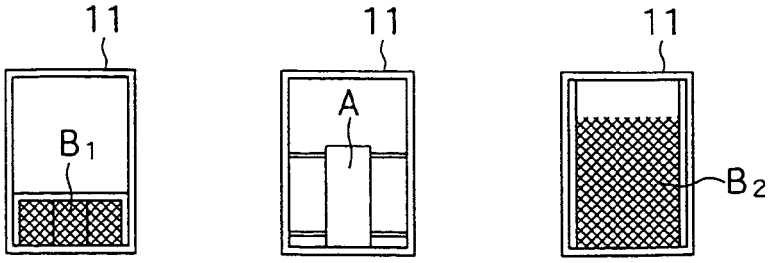
FIG. 12 is a sectional view showing the carrying container and the carrying matter.

Alternatively, it is also allowable to carry the waste matter A and the buffer material B individually by pneumatic transfer, without being limited to the carrying of the waste matter A and the buffer material B that are integrated together. When the carrying of the waste matter A is effected as it is as shown in FIG. 10, a further inside diameter reduction of the individual vertical shaft 12 or the like is obtainable. For the individual carrying of the waste matter A and the buffer material B using the carrying container 11, the carrying of the waste matter A and the buffer material B is effected with an upper buffer material $B_1$, the waste matter A and a lower buffer material $B_2$ stored in three pieces of carrying containers 11 respectively, for instance, as shown in FIG. 12. Then, the positioning is effected in such a manner that the lower buffer material $B_2$ is firstly positioned in the disposal hole 7, the waste material A is then positioned, and the upper buffer material $B_1$ is then positioned on the waste matter A. In the stage of construction, the carrying of the excavation chips or the materials and equipment including the spray concrete may be effected with the excavation chips or the materials and equipment stored in the carrying container 11.

Figure 13:
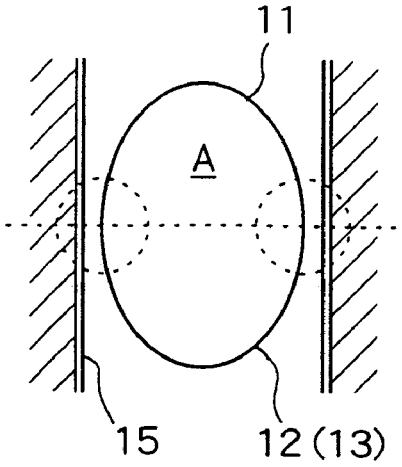
FIG. 13 is a sectional view showing a different embodiment of a carrying matter shape.

FIG. 13 shows an embodiment of a pneumatic transfer system that is independent of a vertical accuracy of the vertical shaft 12. It is possible to attain the carrying independent of an accuracy of excavation to a perpendicularity of the vertical shaft in such a manner as to provide a structure in which the carrying matter such as the carrying container 11 and the waste matter A makes contact with the membrane 15 around the carrying matter only through a plane including a section perpendicular to the vertical shaft 12, in other words, form the carrying matter in a spherical or oval shape, for instance.

Figure 14:
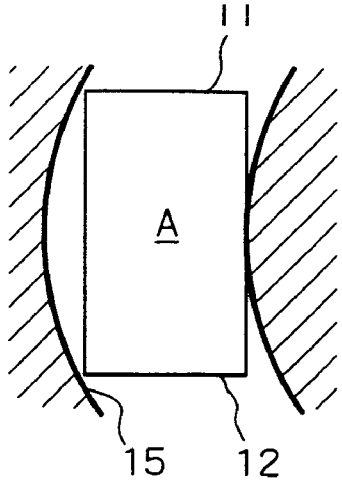
FIG. 14 is a sectional view showing a deformed condition of the vertical shaft.
Figure 15:
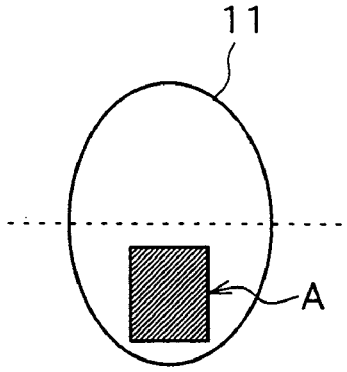
FIG. 15 is a sectional view showing one embodiment of a carrying material position in the carrying matter.

Even if the vertical shaft 12 is in a somewhat vertically deformed condition as shown in FIG. 14, the carrying of the carrying matter may be effected safely in such a manner as to form the carrying matter in the spherical or oval shape or the like. Further, the increased stability during the carrying and at the time of landing is provided by locating the center of gravity of the carrying matter at a position lower than a point of contact of the carrying matter with the membrane in such a manner as to place the waste matter A at the lower part of the carrying container 11, as shown in FIG. 15.

Figure 16:
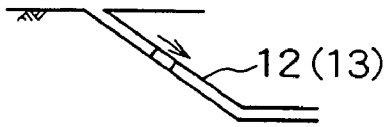
FIG. 16 is a sectional view showing a different embodiment of the vertical shaft.

Alternatively, the individual vertical shaft 12 for carrying need not extending perpendicularly, and may be an inclined or partially curved shaft (with a curve whose radius of curvature is as much as permitting passage of the carrying container or the like), as shown in FIG. 16.

Figure 17:
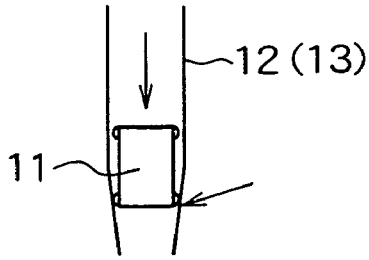
FIG. 17 is a sectional view showing one embodiment of a lower part shape of the vertical shaft.
Figure 18:
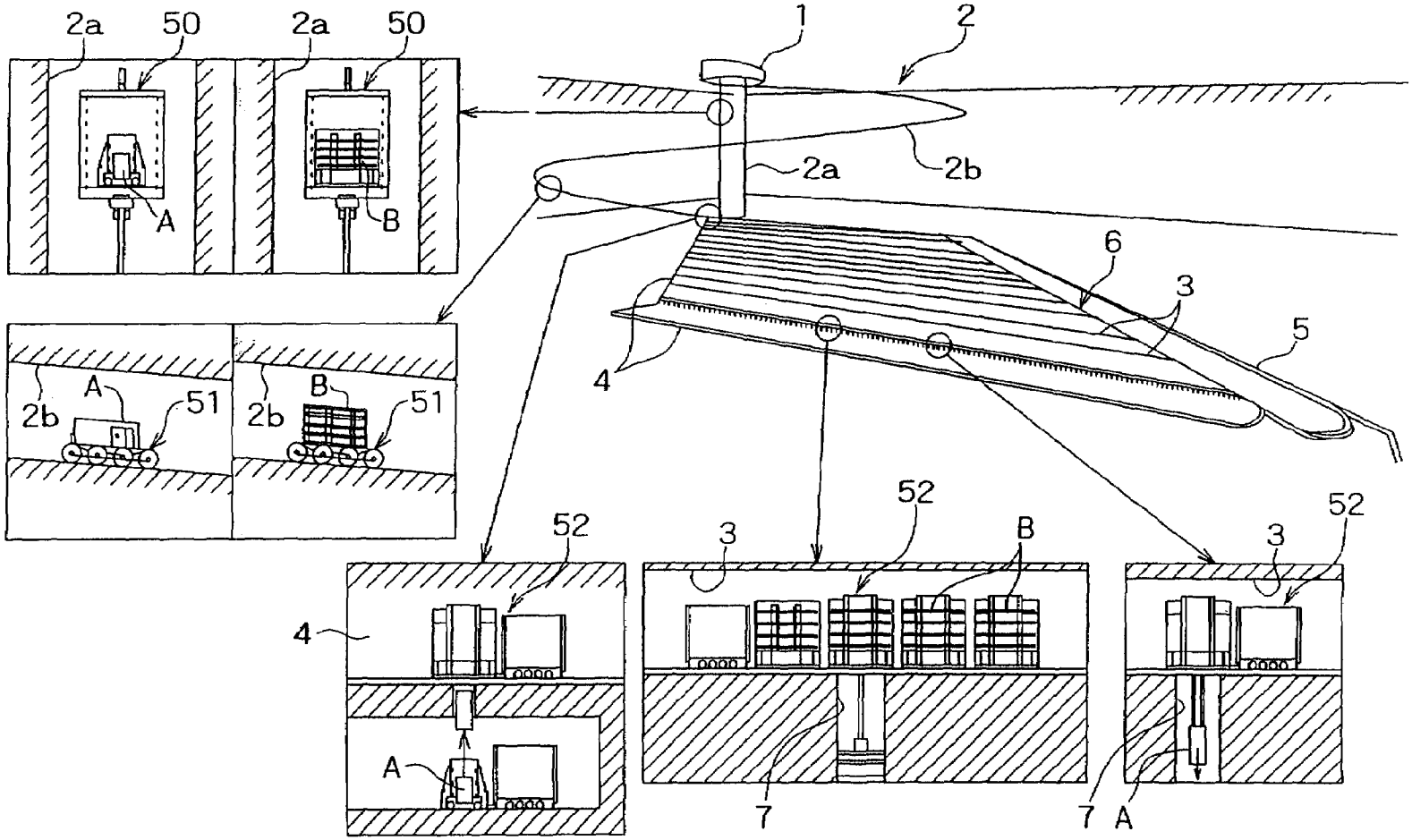
FIG. 18 is a perspective view and a sectional view showing a stratum disposal site of radioactive waste matter and a conventional carrying and positioning method.

Further, with the use of the vertical shaft damper effect at its maximum, the carrying in a spontaneous fall condition may be also effected. When a method of carrying in the spontaneous fall condition is adopted, it is also allowable to increase the damper effect in such a manner as to fill the vertical shaft with liquid such as water. While the vertical shaft damper effect provides a high failsafe against the fall of the carrying matter, the further increased safety may be provided by gradually reducing the lower part diameter of the vertical shaft 12, as shown in FIG. 17.

The differential pressure management applied to a case where the carrying matter is lightweight (the carrying device is capable of being lifted with the atmospheric pressure) is limited to the suction system (with the negative pressure). On the other hand, the differential pressure management applied to a case where the carrying matter is heavy is limited to the press-in system (with the positive pressure).

While the foregoing description relates to the stratum disposal site, it is to be understood that the present invention is not limited to the stratum disposal site, and it is allowable to apply the pneumatic transfer system of the present invention also to construction of the tunnels such as the mountain tunnels. While the stratum disposal of the radioactive waste matter in the mode of positioning with the disposal holes has been described, it is to be understood that the present invention is not limited to the above positioning mode, and it is, of course, allowable to apply the present invention to other positioning modes. It is also to be understood that the present invention is not limited to the burying disposal of radioactive waste matter, and it is also allowable to apply the present invention to the burying disposal of other waste matters.

The present invention has the above arrangements, and therefore, the following effects may be obtained.

(1) Since the present invention employs the pneumatic transfer system for carrying of the excavation chips, the materials and equipment, the waste matter and the buffer material or the like to carry out and carry in the carrying mater by using the difference between the pneumatic pressures at the upper and lower sides of the carrying matter, ① it is allowable to dispense with the conventional wire rope so that any restriction by the depth is eliminated to ensure that the carrying to the greater depth is executable, ② the carrying speed may be increased as compared with that of the conventional wire rope system, ③ the transfer system requires only the differential pressure management, leading to the increase in carrying reliability, ④ the transfer system mechanism is simple, so that high resistance to the troubles is obtainable and the maintenance or management thereof becomes facilitated, and ⑤ there is no necessity of the precise carrying machine, resulting in the increase in economical efficiency. With the above advantages, the carrying-out of the excavation chips or the like and the carrying-in of the materials and equipment in constructing the stratum disposal site and the mountain tunnels or the like, the carrying-in of the waste matter in the stratum disposal site, and the positioning of the waste matter and the buffer material in the stratum disposal site may be effected safely, quickly and reliably at low cost.

(2) With the operation of the pneumatic transfer system, it is allowable to effect the suction of air in the underground facilities or the tunnels to ensure that the ventilation in the underground facilities or in the tunnels is achievable. The air carrying pipeline is also serviceable as the ventilating vertical shaft, and thus requires no arrangement of other ventilation systems, leading to the increase in economical efficiency.

(3) With the use of the vertical shaft or the like itself as the part of the pneumatic transfer system, ① the air carrying pipeline having the strength and the air-tightness may be constructed easily only by placing the lining material and the membrane or the like on the inner side wall of the vertical shaft or the like, and ② the compact transfer system may be given to ensure that the diameter reduction of the vertical shaft or the like is attainable. The above advantages lead to the increase in economical efficiency.

(4) The carrying container is put to practical use in the stratum disposal of the radioactive waste matter, and the waste matter and the buffer material are integrated together at the ground facilities. By positioning and burying the integrated waste matter and buffer material in the disposal space of the underground facilities, together with the carrying container, ① there is no necessity to position the waste matter and the buffer material individually in the underground site, unlike the conventional technology, so that the positioning work may be effected safely, quickly and reliably at low cost, and the positioning reliability and the buffer material quality are increased. ② No swelling of the buffer material is caused because of no permeation of the underground water into the buffer material for a certain period of time since the positioning of the buffer material, so that the retrieving becomes facilitated, and the removal work is also easily performed.

(5) With the air valve provided at the lower part of the air carrying pipeline, the outflow of air from the vertical shaft or the like into the underground facilities or the tunnels is prevented, so that even if the stop of the power supply or the like in the course of carrying brings about the spontaneous fall condition of the carrying matter, the damper effect obtained by the compression action of air at the lower part of the air carrying pipeline may be adapted to prevent the disasters caused by the crash of the carrying matter against the lower part of the underground facilities or the like.

The invention claimed is:

1. A stratum disposal method for disposal of waste matter in a disposal space in an underground gallery, comprising the steps of:

excavating a vertical shaft or an inclined shaft through the ground to communicate with said underground gallery, providing an air carrying pipeline within said shaft at the time of shaft excavation, extending said pipeline within said shaft during continued excavation of the shaft, providing a carrying container to be pneumatically carried within said pipeline, transporting shaft excavation debris from said shaft to ground level by pneumatically carrying said excavation debris placed in said carrying container through said pipeline, transporting materials and equipment for use in excavating said shaft by pneumatically carrying said materials and equipment placed in said carrying container through said pipeline, whereby said shaft is constructed by repeating the steps of excavating said shaft, extending said pipeline within said shaft and transporting said excavation debris to ground level through said pipeline, excavating said underground gallery communicating with said shaft, transporting excavation debris from the excavation of said underground gallery to ground level by pneumatically carrying said excavation debris placed in said carrying container through said pipeline, transporting materials and equipment to the underground gallery by pneumatically carrying said materials and equipment placed in said carrying container through said pipeline, whereby the underground gallery is constructed by repeating the steps of excavating said underground gallery and transporting excavation debris from said underground gallery to ground level through said pipeline, disposing said waste matter in a buffer material surrounding the waste matter in an air-tight integrating container at ground level, pneumatically carrying said integrating container having said waste matter and buffer material therein through said pipeline to said underground gallery, and positioning and burying said integrating container having said waste matter and buffer material therein in said disposal space in said underground gallery.

2. The stratum disposal method according to claim 1, wherein said integrating container having said waste matter and buffer material therein is placed in said carrying container at ground level and carried through said pipeline to said disposal space, and the step of positioning and burying said integrating container in said disposal space includes removing the integrating container from said carrying container.

3. The stratum disposal method according to claim 1, wherein said air carrying pipeline has a lower end connected to an air valve, said air valve is constructed and arranged to be automatically opened by a flow of air created at the time of pneumatic carrying in said pipeline and to be automatically closed by a reverse flow of air created at a time of system failure so that outflow of air from the pipeline through said air valve is prevented.

4. The stratum disposal method according to claim 1, wherein said air carrying pipeline is formed of metal pipe units secured together.

5. A stratum disposal method for disposal of waste matter in a disposal space in an underground gallery, comprising the steps of:

constructing a vertical shaft or an inclined shaft by excavation through the ground, said shaft having an inner wall surface, mounting a member of sufficient strength and airtight seal on said inner wall surface to form an air carrying pipeline, providing a carrying container to be pneumatically carried within said pipeline, excavating an underground gallery communicating with said shaft and pipeline, transporting excavation debris from said underground gallery to ground level by pneumatically carrying said excavation debris placed in the carrying container through said pipeline, transporting materials and equipment to the underground gallery by pneumatically carrying said materials and equipment placed in the carrying container through said pipeline, disposing said waste matter in a buffer material surrounding the waste matter in an airtight integrating container remote of the underground gallery, pneumatically carrying said integrating container having said waste matter and buffer material therein through said pipeline to said underground gallery, and positioning and burying said integrating container having said waste matter and buffer material therein in said disposal space in said underground gallery.

6. The stratum disposal method according to claim 5, wherein said integrating container having said waste matter and buffer material therein is placed in said carrying container at ground level and carried through said pipeline to said disposal space, and the step of positioning and burying said integrating container in said disposal space includes removing the integrating container from said carrying container.

7. The stratum disposal method according to claim 5, wherein said air carrying pipeline has a lower end connected to an air valve, and said air valve is constructed and arranged to be automatically opened by a flow of air created at the time of pneumatic carrying in said pipeline and to be automatically closed by a reverse flow of air created at a time of system failure so that outflow of air from the pipeline through said air valve is prevented.

8. The stratum disposal method according to claim 5, further including applying a concrete lining to said inner wall surface and said mounting member comprises a metal plate extending over said concrete lining.

* * * * *